United States Patent [19]

Mun et al.

[11] Patent Number: 4,790,146

[45] Date of Patent: Dec. 13, 1988

[54] REFRIGERATOR

[75] Inventors: Im H. Mun, Soowonsi; Jang E. Young, Bangbae; Park J. Hun, Soowonsi; Suh M. Hwan, Ahnyansi, all of Rep. of Korea

[73] Assignee: Sam Sung Electronics Co., Ltd., Maitan, Rep. of Korea

[21] Appl. No.: 995

[22] Filed: Jan. 7, 1987

[30] Foreign Application Priority Data

Mar. 4, 1986 [KR] Rep. of Korea ..... 86-2533
Mar. 20, 1986 [KR] Rep. of Korea ..... 86-3410
Aug. 20, 1986 [KR] Rep. of Korea ..... 86-12654

[51] Int. Cl.[4] ..... F25D 11/02

[52] U.S. Cl. ..... 62/441; 49/388; 312/328

[58] Field of Search ..... 62/441, 443, 446, 459, 62/517, 520, 522, 344; 49/388, 246, 260, 261, 460, 386; 312/138 A, 328, 329, 109, 110, 325, 320

[56] References Cited

U.S. PATENT DOCUMENTS

| | | | |
|---|---|---|---|
| 1,946,496 | 2/1934 | Kleist | 62/446 |
| 2,091,584 | 8/1937 | Brown | 62/520 |
| 2,381,686 | 8/1945 | Peltier | 62/520 |
| 2,676,864 | 4/1954 | Townsend | 49/386 X |
| 3,005,321 | 10/1961 | Devery | 62/441 X |
| 3,019,619 | 2/1962 | Hilliker | 62/441 X |
| 3,098,686 | 7/1963 | Benoit | 312/320 |
| 3,292,983 | 12/1966 | Service | 312/329 |
| 3,602,007 | 8/1971 | Drieci | 62/441 X |
| 3,788,089 | 1/1974 | Graves | 62/520 X |
| 4,095,439 | 1/1978 | Linstromberg | 62/344 |
| 4,163,344 | 8/1979 | Scherer | 49/386 |
| 4,333,588 | 6/1982 | Schreck et al. | 62/344 X |

*Primary Examiner*—William E. Tapolcai
*Attorney, Agent, or Firm*—Antonelli, Terry & Wands

[57] ABSTRACT

A refrigerator is formed with a freezer compartment beneath a cold storage compartment for the purpose of adopting a single evaporator for two temperature compartment by disposing an evaporator between two compartments, further for operating a freezer compartment with a natural convection and a cold storage compartment with a forced circulation. Therefore a door of a freezer compartment is opened downwardly for the requirement of above facilities and a automatic ice making device which is settled on the shelf of an evaporator drops the ices into the ice pocket fixed to the door back during the door is closed. A door handle of "∩" shaped in section is adopted for use with downward opening door of a freezer compartment.

1 Claim, 4 Drawing Sheets

REFRIGERATOR

FIELD OF THE INVENTION

The present invention relates to a refrigerator and, more specifically, relates to a refrigerator in which a freezer compartment is located at a lower position and contains an automatic ice making device, and a door of a freezer compartment is of the tilt type, in that the door is opened by pulling, downwardly and is closed by pushing upwardly. A door handle can be used for opening and closing of the door.

BACKGROUND OF THE INVENTION

Generally among the cooling systems of a refrigerator, the natural convection system has the evaporators separately in each of a cold storage compartment and a freezer compartment so that the cooling is accomplished by the natural convection. It has the advantages that the cooling efficiency of a freezer compartment is large and the energy can be saved. It also has the disadvantages that the cooling distribution of the cold storage compartment becomes uneven and frost is generated frequently. A forced circulation system circulates the chilled air through the evaporator with the fans into the freezer compartment and cold storage compartment. It has the advantages that the automatic control is easy and the cooling distribution is even, but has disadvantages in that the cooling efficiency is much lower and noise is generated. Therefore in a refrigerator, it is most desirable to cool the freezer compartment with the natural convection system and the cold storage compartment with the forced circulation system.

The usual refrigerator locates a freezer compartment on the upper position and a cold storage compartment at the lower position. With this arrangement, it is very difficult to cool the freezer compartment with natural covection and the cold storage compartment with forced circulation.

These problems as described in above can be solved simply by locating the freezer compartment beneath the cold storage compartment. However, if the freezer compartment is located beneath the cold storage compartment, it is inconvenient to use the door handle because the opening and closing direction of the door of the freezer compartment is in the direction of right and left. Thus, a user's hand can not reach into a freezer compartment easily since the ice making portion of a freezer compartment is normally located at the corner of the freezer compartment.

Meanwhile, devices for automatic ice making have been suggested more recently in order to provide ice making facilities in the refrigerator.

A typical automatic ice making device has a heater in the bottom of the container, and a rotatable driving-out mechanism is provided atop the automatic ice making device. When the water which is supplied through water service pipe is to be frozen, the heater melts the ice forming a contacting surface between the container and the ice, they are separated from each other, and subsequently the driving-out mechanism rotates and drives the ice out of the container, so that the ice is dropped into an another container where it is stored.

With this type of ice making device, even though the freezer compartment is located at a lower position from the cold storage compartment, it is easier to handle ice making.

OBJECT OF THE INVENTION

The major object of the present invention is to solve the several proplems described above. We have done so by providing a refrigerator in which the evaporator with an automatic ice making device is installed in the upper space of the freezer compartment of a refrigerator which, the freezer compartment is located at the lower part of the refrigerator, and a door handle of variable use is attached so that a door of the freezer compartment is opened and closed by movement upwardly and downwardly.

Another object of the present invention is to provide a door of the freezer compartment which can be held in multiple position at any desired angle.

SUMMARY OF THE INVENTION

The present invention is particularly applicable to a refrigerator in which a freezer compartment is located beneath a cold storage compartment so that the refrigeration of freezing and cold storing can be obtained by a single evaporator which is installed between the freezer compartment and the cold storage compartment.

This arrangement allows a freezer compartment to operate with a natural convection system and a cold storage compartment to operate with a forced circulation system.

An automatic ice making device is provided on the shelf of an evaporator and is automatically controlled to make the ice and drop it out of the freezing container.

A outstanding feature of the instant invention is that an ice pocket or bucket is installed on the inside panel of a door of a freezer compartment into which the ice from the ice making device is dropped and piled when the door is closed. The freezer compartment door is opened downwardly and closed upwardly so that the ice can be drawn out easily.

Another feature of the instant invention is that a freezer compartment door is provided with arcuate guide rails and rollers which roll thereon, the rollers being fixed to levers on the side walls of the ice pocket.

Another feature of the instant invention is that the freezer compartment door handle is "∩" shaped in section and has upper supporting pieces parallel to each other with a small distance therebetween sufficient to fit the door frame sash, and lower supporting pieces of similar shape to fit the front panel of the door. This "∩" shaped handle is attached tightly to the door by means of polyurethane foam which fills the inside of the door structure.

DISCLOSURE OF THE PREFERRED EMBODIMENTS OF THE PRESENT INVENTION

Figure 1:
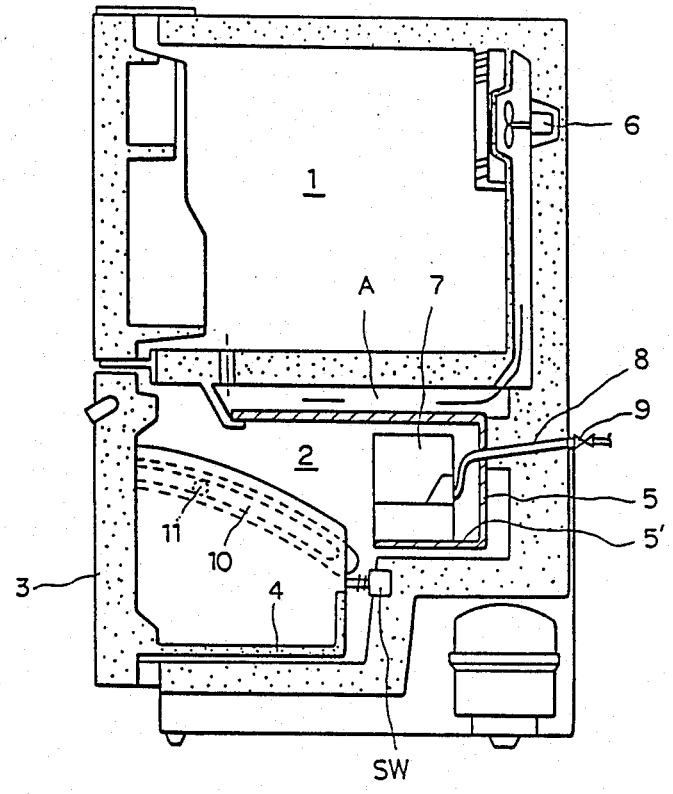
FIG. 1 is a sectional side view which shows a structure of a refrigerator of the first embodiment according to the present invention.

The structure and advantages of the instant invention will become more apparent as reference is made to the drawings wherein numeral 1 in FIG. 1 denotes a cold storage compartment which is located at an upper portion of a refrigerator, and numeral 2 denotes a freezer compartment which is located at a lower part of the refrigerator. A door (3) of the freezer compartment (2) is fixed to be able to open and close downwardly and upwardly, and a ice pocket (4) is formed integrally to the inside of the door. An evaporator (5) having a " " shaped section is disposed on an upper space of the freezer compartment (2), the upper part of this evaporator (5) forms a boundary layer by itself, and a chilled air circulating duct A is formed between the freezer compartment and the cold storage compartment so that the cooling of the cold storage compartment (1) is accomplished with a forced circulation system by means of a fan motor (6) and, on the other hand the freezer compartment (2) is refrigerated with a natural convection system.

A conventional automatic ice making device (7) is arranged on the lower shelf of the evaporator (5). A water supply pipe (8) from an outer service pipe (not shown) is connected to the automatic ice making device (7) and a solenoid valve (9) in pipe (8) opens and closes automatically.

Figure 2:
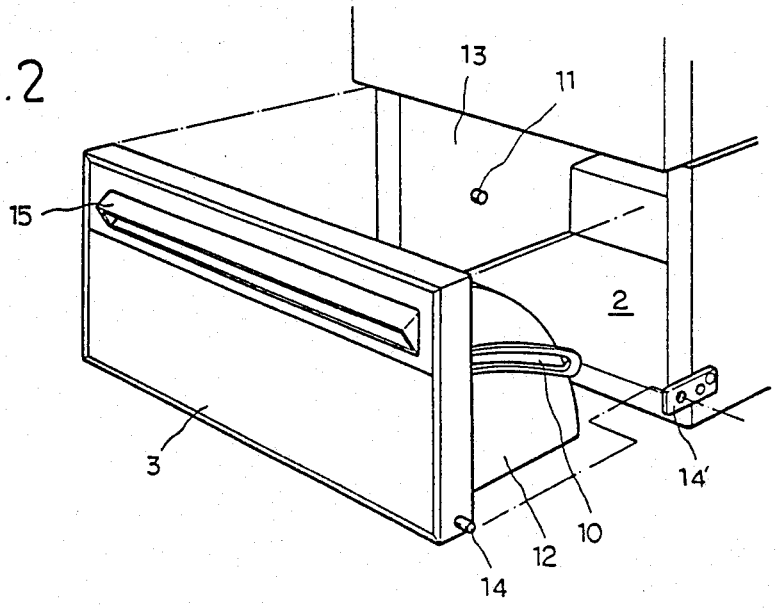
FIG. 2 is a partial perspective view of the freezer compartment of the first embodiment according to present invention to show the opening and closing structure of the freezer compartment door.

The aforementioned door (3) of the freezer compartment has guide rails (10) which are guided by the fixed pins (11). FIG. 2 shows the structure of the door of the freezer compartment, wherein the guide rails (10) are attached to both side walls (12) of the ice pocket (4), and the fixed pins (11) protrude from the inside walls (13) of the freezer compartment. Further the door (3) is opened and closed downwardly and upwardly by inserting the axle pins (14) protruding from the lower side end of the door into the bracket holes (15). When the door is closed, a front end of the ice pocket (4) pushes the switch (SW) of an automatic ice making device (7) and turns it on.

Figure 3:
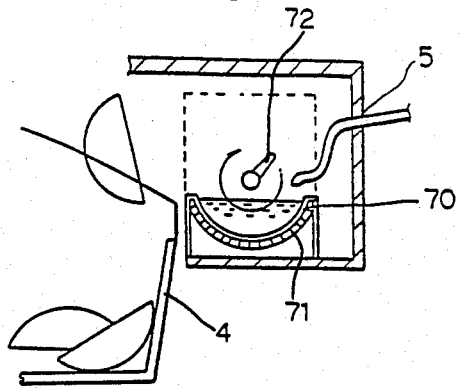
FIG. 3 is a diagramatic view which shows an automatic ice making device used with the present invention.

FIG. 3 illustrates schematically the structure of the usual automatic ice making device (7) and the manner in which this device is used with the present invention. When water is supplied into a semicircular freezing container (70) and filled to an appropriate level, the solenoid valve (9) closes. Then the water will be frozen in the semicircular freezing container (70) by the refrigeration caused by the evaporator (5). When the ice is made completely, a sensor (not illustrated) turns a heater (71) on to heat the bottom of a semicircular container (70) and melt the ice-container interface so as to separate the ice from the container (70). Consequently the driving out device (72) which is arranged above the freezing container (70) rotates and drives the ice out of the freezing container (70) so that the ice is dropped into the ice pocket (4) and piled naturally.

According to the present invention, even though a freezer compartment (2) is located at a lower position in the refrigerator, because of the door (3) which can be opened and closed downwardly and of upwardly and the ice pocket (4) which is formed integrally with the inside of the door, it is very easy and convenient to pick up the ice from a refrigerator. In addition, the ice will be made automatically by an automatic ice making device (7) which is easily accomodated by. the " ⊐ " shaped evaporator (5).

Figure 4:
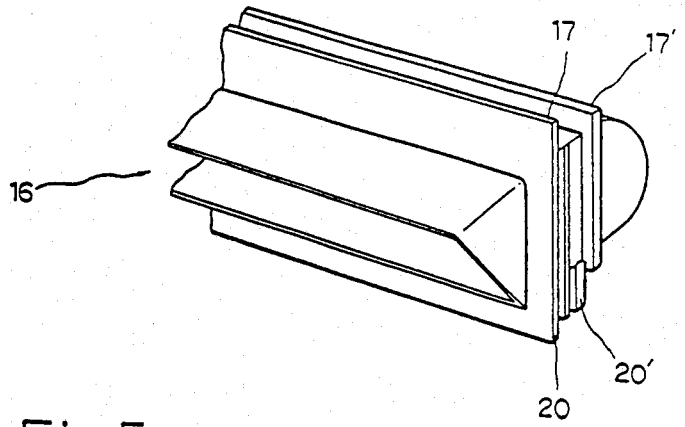
FIG. 4 is a partial perspective view of a door handle according to the present invention.
Figure 5:
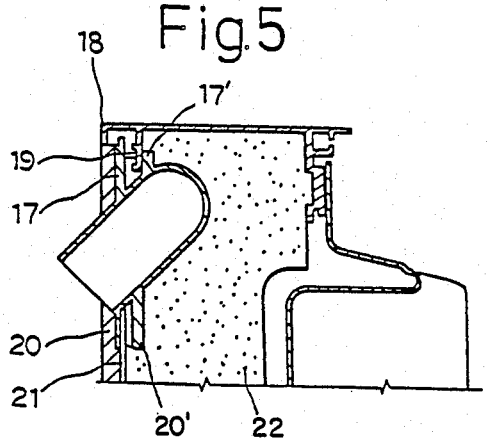
FIG. 5 is a partial, sectional view of the installed door handle according to the present invention.

FIG. 4 and FIG. 5 show the door handle (16) which is "∩" shaped and fixed to the upper part of the door in an inclined position. The upper supporting pieces (17) (17') have a distance between them which allows the handle to be fixed to the edge (19) of the door sash (18). The the lower supporting pieces (20) (20') are fixed to the front panel (21) of the door (3) so as to facilitate the door opening downwardly and closing upwardly. The aforementioned door handle (16) is fixed tightly by means of the polyurethane foam which fills the freezer compartment door.

Figure 6:
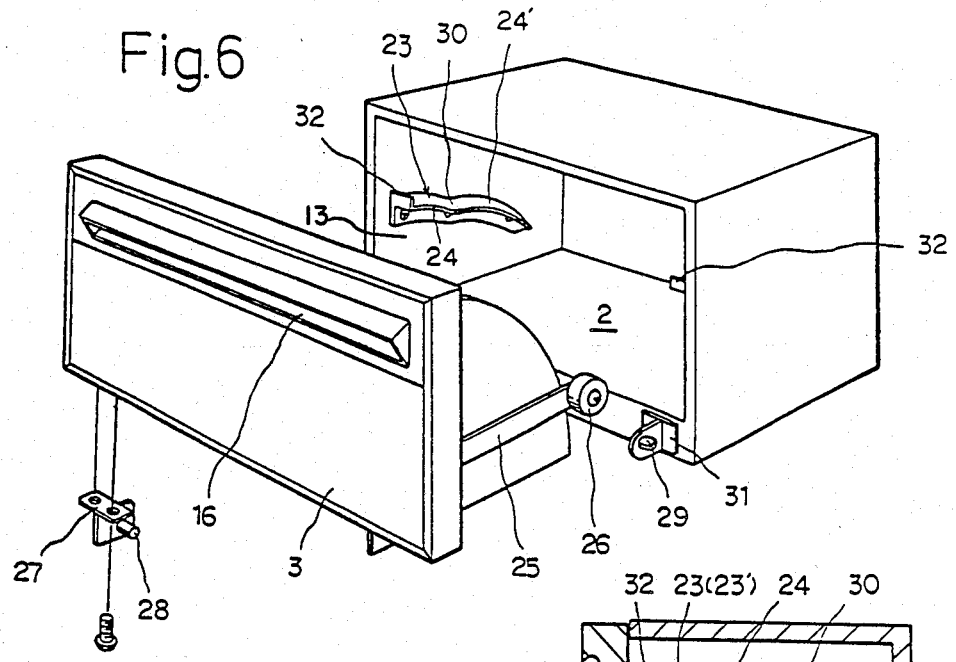
FIG. 6 is a perspective view similar to FIG. 2, but which shows the opening and closing structure of the door of a freezer compartment of a second embodiment according to the present invention.
Figure 7:
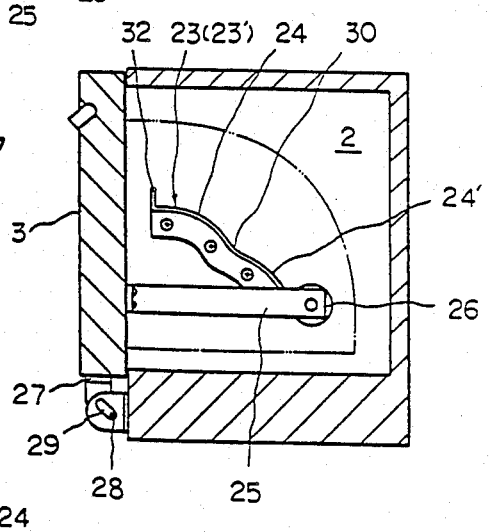
FIG. 7 is a sectional side elevation view of FIG. 6.

FIG. 6 and FIG. 7 show another embodiment of the present invention in which the door (3) is opened and closed in two steps. The guide rails (23) (23') which are formed with continuous double arcs and the sliding surfaces (24) (24') attached integrally along therewith are fixed to both of the inside walls (13), and the rollers (26) on the levers (25) roll along the surfaces (24) (24'). The axle pins (28) of the male hinges (27) fixed to the door (3) are inserted into the oblong holes (29) of the female hinges (31) fixed an the freezer compartment case (2). The door (3) is opened downwardly around the said axle pins (28), and the rollers (26) are guided by the guide rails (23) (23') as well as the sliding surfaces (24) (24').

When the door (3) is closed, the axle pins (28) are at the lowest ends of the long holes (29) of the female hinges (31), and the rollers (26) fixed to the front ends of the levers (25) are at the lowest ends of the guide rails (23'). If the door is opened from this fully closed position, the door (3) rotates around the axle pins (28) which form the center of the arcs of the guide rail (23'). At the same time the rollers (26) roll up along the guide rails (23'), and accordingly the door (3) is opened. Subsequently, when the rollers (26) reach the recesses (30) of the connecting part between two guide rails (23) (23'), the rollers (26) will come to a stop not be able to get out therefrom unless the position of the axle pins (28) is changed because the center of the arcs of the guide rails (23) is different from the center of the guide rails (23').

Figure 8:
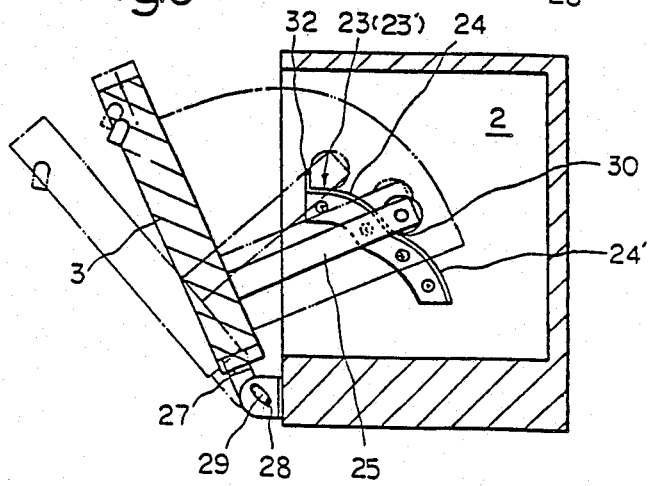
FIG. 8 is a sectional view which shows successive movement of the door as in FIG. 7.
Figure 9:
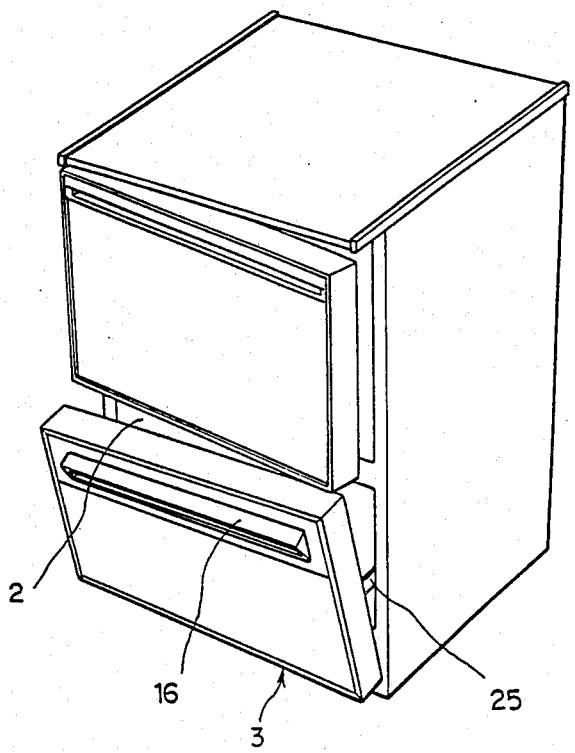
FIG. 9 shows the perspective view of an embodiment according to the present invention.

In order to open the door (3) as wide as necessary, the door (3) should be pulled up untill the axle pins (28) change position to the highest position in the oblong hole (29). At this position, the rollers (26) can roll again, this time along on the guide rails (23) because the axle pin (28) has become the center of the arc of these guide rails (23). Then the door (3) will be opened up to the position shown in phantom lines in FIG. 8. In this position the door (3) can not be opened further because the rollers (26) are halted by the stops (32). Therefore the door (3) can be opened in two steps and as much as required to withdraw from goods, It is as easy to shut as it is to open the door and the angle of the door opening can be controlled and manufactured to meet varying requirements by changing the length of guide rails or the position of the recesses.

What is claimed is:

1. A refrigerator having a cold storage compartment and a freezer compartment located below the cold storage compartment, the freezer compartment being provided with a door which opens downwardly and closes upwardly, and said door being provided with a handle, wherein said door has lever means connected thereto, roller means being operatively associated with said lever means, guide rail means being provided on the interior of said freezer compartment and having a sliding surface which cooperates with said roller means, wherein the sliding surface of said guide rail means defines two connected arcs whose centers are displaced from each other, and pivot means connecting said door with said freezer compartment for permitting said door to be opened and closed by moving said roller means from one arc on the sliding surface to the other arc on the sliding surface and, wherein said pivot means comprises an axle pin on one of said door and freezer compartment and a female member with an oblong hole on the other of said door and freezer compartment to receive the axle pin such that one end of the oblong hole defines the center for one arc and another end of the oblong hole defines the center for the other arc so that the door can be opened and closed in a two-step action.

* * * * *